US005994825A

United States Patent [19]

Goto et al.

[11] Patent Number: 5,994,825

[45] Date of Patent: Nov. 30, 1999

[54] ELECTRIC LAMP WITH A BASE

[75] Inventors: Hiroshi Goto; Masayuki Umehara, both of Shizuoka, Japan

[73] Assignee: Koito Manufacturing Co., Ltd., Tokyo, Japan

[21] Appl. No.: 08/897,625

[22] Filed: Jul. 21, 1997

[30] Foreign Application Priority Data

Jul. 22, 1996 [JP] Japan ..... 8-209372

[51] Int. Cl.[6] ..... H01J 5/48; H01J 5/50

[52] U.S. Cl. ..... 313/318.07; 313/318.09; 313/318.01

[58] Field of Search ..... 313/318.01, 318.09, 313/318.07, 318.1, 578, 579, 580, 634, 624; 362/306, 288, 368, 369, 370, 371; 439/220, 222, 223

[56] References Cited

U.S. PATENT DOCUMENTS

| | | | |
|---|---|---|---|
| 4,013,335 | 3/1977 | Varkonyi et al. | 339/144 R |
| 4,256,989 | 3/1981 | Trutner et al. | 313/318 |
| 4,769,574 | 9/1988 | Nagawawa et al. | 313/318 |
| 4,864,183 | 9/1989 | Okano | 313/318 |
| 4,950,953 | 8/1990 | Ito et al. | 313/564 |
| 5,043,624 | 8/1991 | Hirozumi et al. | 313/318 |
| 5,339,002 | 8/1994 | Braun et al. | 313/318 |
| 5,818,154 | 10/1998 | Helbig et al. | 313/318.01 |

FOREIGN PATENT DOCUMENTS

| | | |
|---|---|---|
| 61757 | 10/1982 | European Pat. Off. . |
| 2 322 453 | 3/1977 | France . |

*Primary Examiner*—Nimeshkumar D. Patel
*Assistant Examiner*—Michael J. Smith
*Attorney, Agent, or Firm*—Sughrue, Mion, Zinn, Macpeak & Seas, PLLC

[57] ABSTRACT

In the electric lamp with a base in which a bulb capsule including a pinch seal portion 3 in one end portion of a glass bulb connects with a hold plate in such a manner that the pinch seal portion is held by and between hold pieces respectively provided in the hold plate, a section of the pinch seal portion side end portion of the glass bulb,with which the glass bulb side hold pieces of the hold plate are to be engaged, is formed larger in thickness than the remaining sections of the pinch seal portion side end portion.

7 Claims, 5 Drawing Sheets

ELECTRIC LAMP WITH A BASE

BACKGROUND OF THE INVENTION

1. Field of the Invention

The present invention relates to an electric lamp with a base including a bulb capsule and a hold plate for holding the bulb capsule, in which the bulb capsule includes a pinch seal portion formed in one end portion of a glass bulb provided in the bulb capsule, and the hold plate includes two or more hold pieces, while the pinch seal portion of the bulb capsule can be connected with and held by the hold plate in such a manner that the pinch seal portion of the glass bulb of the bulb capsule is held by and between the hold pieces of the hold plate, and, in particular, to a technology which prevents the glass bulb of the bulb capsule against damage when or after the bulb capsule is held by the hold plate.

2. Related Art

FIGS. 6 and 7 show an example of a conventional electric lamp with a base.

In these figures, reference character a designates a bulb capsule of a halogen lamp. Reference character b stands for a glass bulb which is sealed in such a manner that one end of which is closed by a pinch seal portion c, with the other end thereof closed by an air exhaust portion d. Reference numeral e designates lead wires which are inserted through the pinch seal portion c, while the intermediate portions of the lead wires e are held by the pinch seal portion c. Here, filaments f are provided between the suitable leading ends of the lead wires e.

The pinch seal portion c is formed in a substantially flat shape and, on the two sides in the width direction of the pinch seal portion c, there are provided projecting strips g on the two side surfaces of the pinch seal portion c, so that the pinch seal portion c has a section of a substantially I shape. Further, in the substantially central portions of the two side surfaces of the pinch seal portion c, there are provided engaging projection sections h.

A hold plate i formed of a metal plate having spring elasticity has a substantially circular shape when it is viewed from top, and includes a peripheral edge which is bent stepwise.

The hold plate i includes a hold surface i. On the hold surface i, there are provided two pairs of intermediate hold pieces k and two pairs of side hold pieces l which are respectively formed by cutting and raising the corresponding portions of the hold surface i. The intermediate hold pieces k are formed opposed to each other, are respectively bent downwardly (in FIGS. 6 and 7, toward the lower edge side of the present drawing sheet) from the hold surface i, and are inclined in such a manner that the leading ends m of the mutually opposed hold pieces k are allowed to approach each other. On-the other hand, the side hold pieces l are similarly formed opposed to each other, are respectively bent upwardly from the hold surface i, and are inclined in such a manner that the leading ends n of the mutually opposed hold pieces l are allowed to approach each other.

Thus, the bulb capsule a is inserted into the hold plate i in such a manner that the pinch seal portion c of the bulb capsule a is inserted from above between the hold pieces k and l until, as can be seen in FIG. 7, the leading ends n of the hold pieces l contact the lower end portion of the glass bulb b, that is, the end portion o thereof on the pinch seal side. In this state (which is shown in FIG. 7), the intermediate hold pieces k are arranged in such a manner that the leading ends thereof m are located below the hold surface i and are elastically contacted with the side surface of the intermediate portion of the pinch seal portion c from both sides, while the leading ends thereof m are also engaged with the upper surfaces of the engaging projection sections h provided on the side surfaces of the pinch seal portion c.

On the other hand, the side hold pieces l are arranged in such a manner that the leading ends thereof n are located above the hold surface i, and are elastically contacted with the side surface of the intermediate portion of the pinch seal portion c from both sides and engaged with the pinch seal portion side end portion o of the glass bulb b, thereby preventing the bulb capsule a from being removed from the hold plate i.

However, in the above-mentioned conventional electric lamp with a base, when the bulb capsule a is held by the hold plate i, the sharp edges p of the leading ends n of the side hold pieces l are engaged with the pinch seal portion side end portion o of the glass bulb b, which causes the glass bulb b and pinch seal portion c to be damaged or cracked, thereby increasing the rate of production of poor products in an electric lamp manufacturing process.

SUMMARY OF THE INVENTION

In view of this, the present invention aims at eliminating the drawbacks found in the above-mentioned conventional electric lamp with a base. Accordingly, it is an object of the invention to provide an electric lamp with a base which, when the bulb capsule thereof is held by a hold plate serving as a base, prevents the bulb capsule from being damaged, especially, a glass bulb of the bulb capsule from being damaged.

In attaining the above object, according to the invention, the pinch seal portion side end portion of the glass bulb is structured such that a section thereof, with which the glass bulb side hold pieces of the hold plate can be engaged, is formed larger in thickness than the remaining sections of the glass bulb side hold pieces.

Therefore, according to the invention, since the pinch seal portion side end portion of the glass bulb is structured such that the section thereof, with which the glass bulb side hold pieces of the hold plate can be engaged, is formed larger in thickness than the remaining sections thereof, even if stresses due to the engagement of the glass bulb side hold pieces are concentrated on the present section, the present section is able to stand such concentrated stresses.

Further, according to another aspect of the invention, the contact surface of the contact section of the pinch seal portion side end portion of the glass bulb, with which the glass bulb side hold pieces are to be engaged, is formed such that it makes an angle of almost 90 degrees with respect to the pinch seal portion.

Therefore, a pressing force due to the engagement of the glass bulb side hold pieces can be received almost at right angles with respect to the direction of action of the pressing force.

Further, each of the glass bulb side hold pieces is so formed as to have a bent portion, the outer section of the bent portion is engaged with the pinch seal portion side end portion of the glass bulb, and the leading end of the bent portion is so extended toward the pinch seal portion as to provide a clearance between the pinch seal portion and itself.

Therefore, since the outer sections of the bent portions of the glass bulb side hold pieces are in contact with the pinch seal portion side end portion of the glass bulb, there is eliminated the possibility that there can be generated any burr in the outer sections of the bent portions, thereby preventing the pinch seal portion side end portion of the glass bulb against damage. Also, because the section of the leading end portion of the glass bulb, in which burrs are produced, is spaced apart from the pinch seal portion, there is also eliminated the danger that the pinch seal portion can be damaged.

DESCRIPTION OF THE PREFERRED EMBODIMENTS

Figure 1:
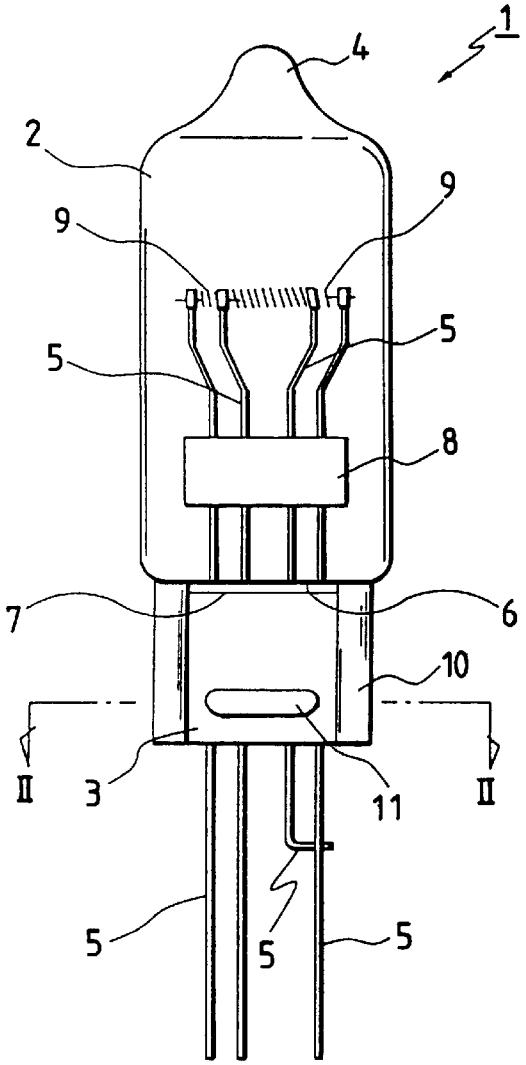
FIG. 1 is a side view of a bulb capsule, showing an example of an embodiment of an electric lamp with a base according to the invention together with FIGS. 2 to 5.
Figure 2:
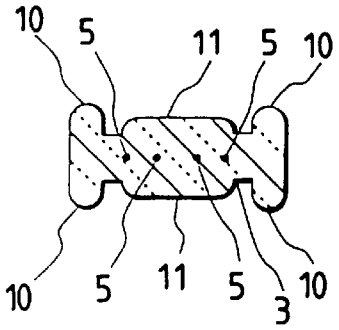
FIG. 2 is a section view taken along the line II—II shown in FIG. 1.
Figure 3:
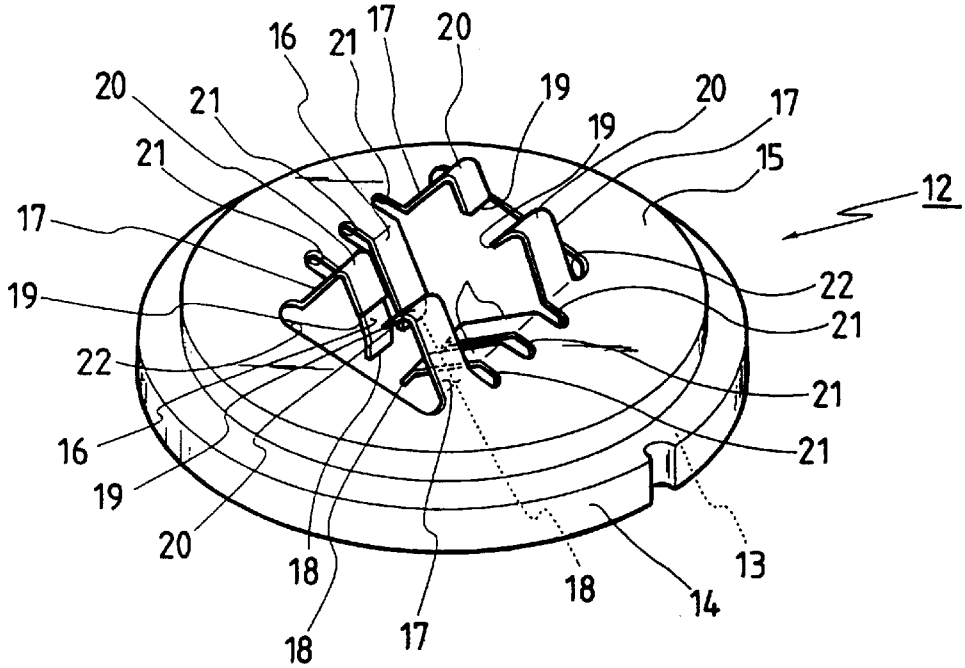
FIG. 3 is a perspective view of a hold plate employed in the invention.
Figure 4:
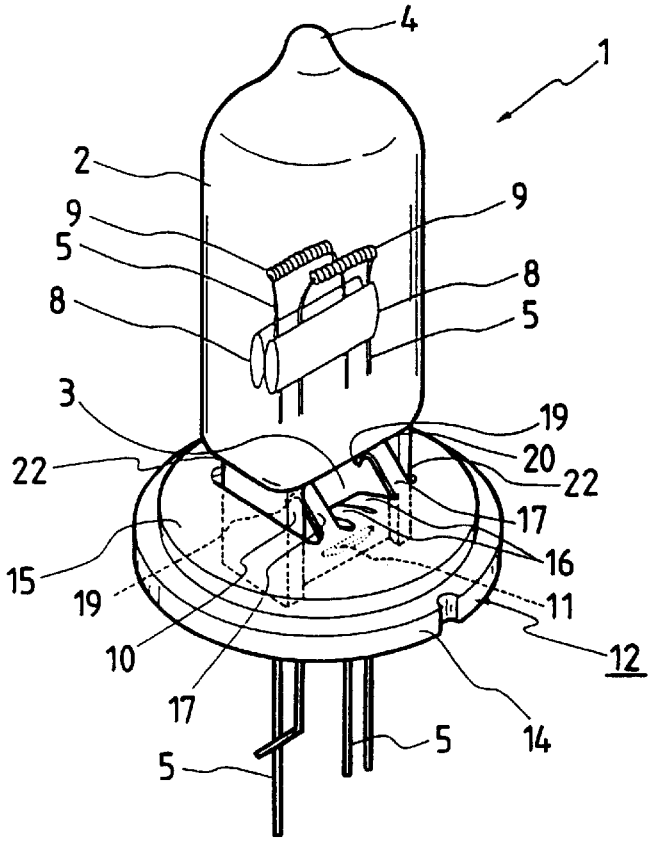
FIG. 4 is a perspective view of the electric lamp, showing a state thereof in which a bulb capsule is connected to a hold plate.

Now, a preferred embodiment of the present invention will be described with reference to the accompanying drawings.

Here, reference character 1 designates a bulb capsule of a halogen lamp, and, 2 stands for a glass bulb which is sealed in such a manner that one end thereof is closed by a pinch seal portion 3 and the other end is closed by an air exhaust portion 4. Lead wires 5 are inserted through the pinch seal portion 3, while the intermediate portions of the lead wires 5 are respectively held by the pinch seal portion 3.

Also, a section of the pinch seal portion side end portion 6 of the glass bulb 2, which is near to the base end of the pinch seal portion 3, is formed larger in thickness than the remaining sections thereof to thereby provide a thick section 7.

The thick section 7 is formed in such a manner that it projects outwardly (downwardly) from the glass bulb 2, while the lower surface of the thick section 7 is so formed as to be almost at right angles to the pinch seal portion 3.

Glass bridges 8 are welded in such a manner that they hold the lead wires 5 between them within the glass bulb 2. Filaments 9 are provided between the leading ends of the properly selected ones of the lead wires 5.

The pinch seal portion 3 is formed in a substantially flat shape, and includes projecting strips 10 on the two side surfaces thereof which are situated on the two sides thereof in the width direction thereof. In the substantially central portions of the two side surfaces of the pinch seal portion 3, there are provided engaging projection sections 11 which extend in the width direction of the pinch seal portion 3, while the two ends of each of the engaging projection sections 11 are respectively spaced apart from their corresponding projecting strips 10 by a proper clearance. By the way, in the glass bulb 2, there are sealedly contained an inert gas and a proper halogen gas. The bulb capsule 1 is structured in the above-mentioned manner.

Reference character 12 stands for a hold plate which is formed of a metal plate having spring elasticity, while it has a substantially circular shape when it is viewed from top. And, the peripheral edge of the hold plate 12 is bent downward stagewise to thereby provide a contact surface 13 facing downward and a staking edge 14 bent downward from the outer peripheral edge of the contact surface 13. Further, when such hold plate 12 is fitted with the outside of a tubular metal member (not shown) and the staking edge 14 thereof is then staked, then there is provided a base body.

The hold plate 12 includes a hold surface 15 and, in the portions of the hold surface 15 near to the central portion thereof, there are provided two pairs of pinch seal side hold pieces 16 and two pairs of glass bulb side hold pieces 17, which are respectively formed by cutting and raising their corresponding portions of the hold surface 15.

The paired pinch seal side hold pieces 16 are formed opposed to each other, are respectively bent from the hold surface 15 in an obliquely downward direction (in FIG. 5, toward the lower edge of the present drawing sheet), and further the leading end portions thereof 18 are respectively bent downward.

On the other hand, the paired glass bulb side hold pieces 17 are formed opposed to each other, and are respectively bent from the hold surface 15 in an obliquely upward direction, while there are further formed bent portions 20 so that the leading end portions 19 of the glass bulb side hold pieces 17 can be respectively bent in an obliquely downward direction. Also, the distances between the leading end portions of the mutually opposed glass bulb side hold pieces 17 are set slightly larger than the thicknesses of the portions of the pinch seal portion 3 in which no projecting strips are formed.

And, between the respective base portions of the hold pieces 16 and 17, there are formed slits 21 which are used to give more elasticity to the these hold pieces. Also, outside the glass bulb side hold pieces 17, there are formed spaces 22. Thus, a space, which is formed due to the formation of the spaces 22 and the above-mentioned respective hold pieces, when viewed from above, can have a substantially I shape which corresponds to the section shape of the pinch seal portion 3 of the bulb capsule 1.

Figure 5:
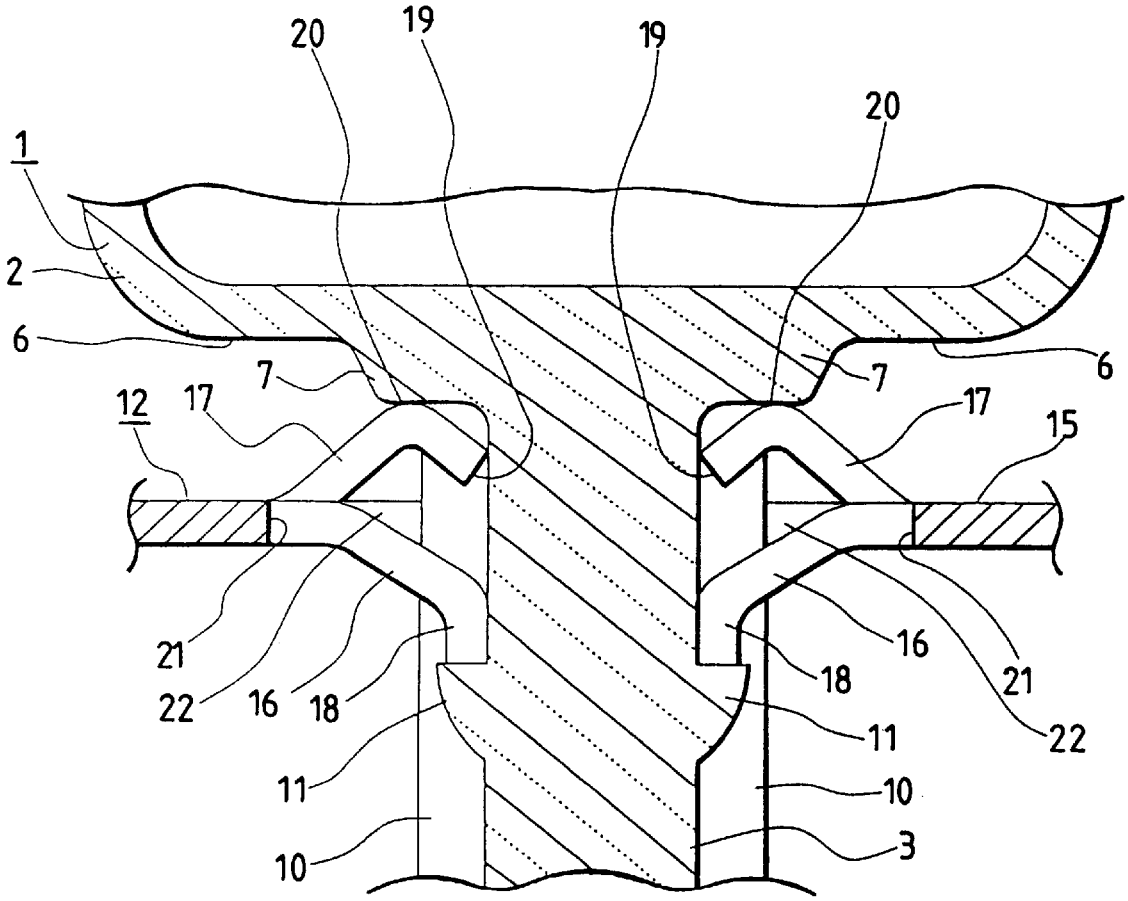
FIG. 5 is an enlarged section view of the main portions of the electric lamp, showing a state thereof in which a bulb capsule is connected to a hold plate.
Figure 6:
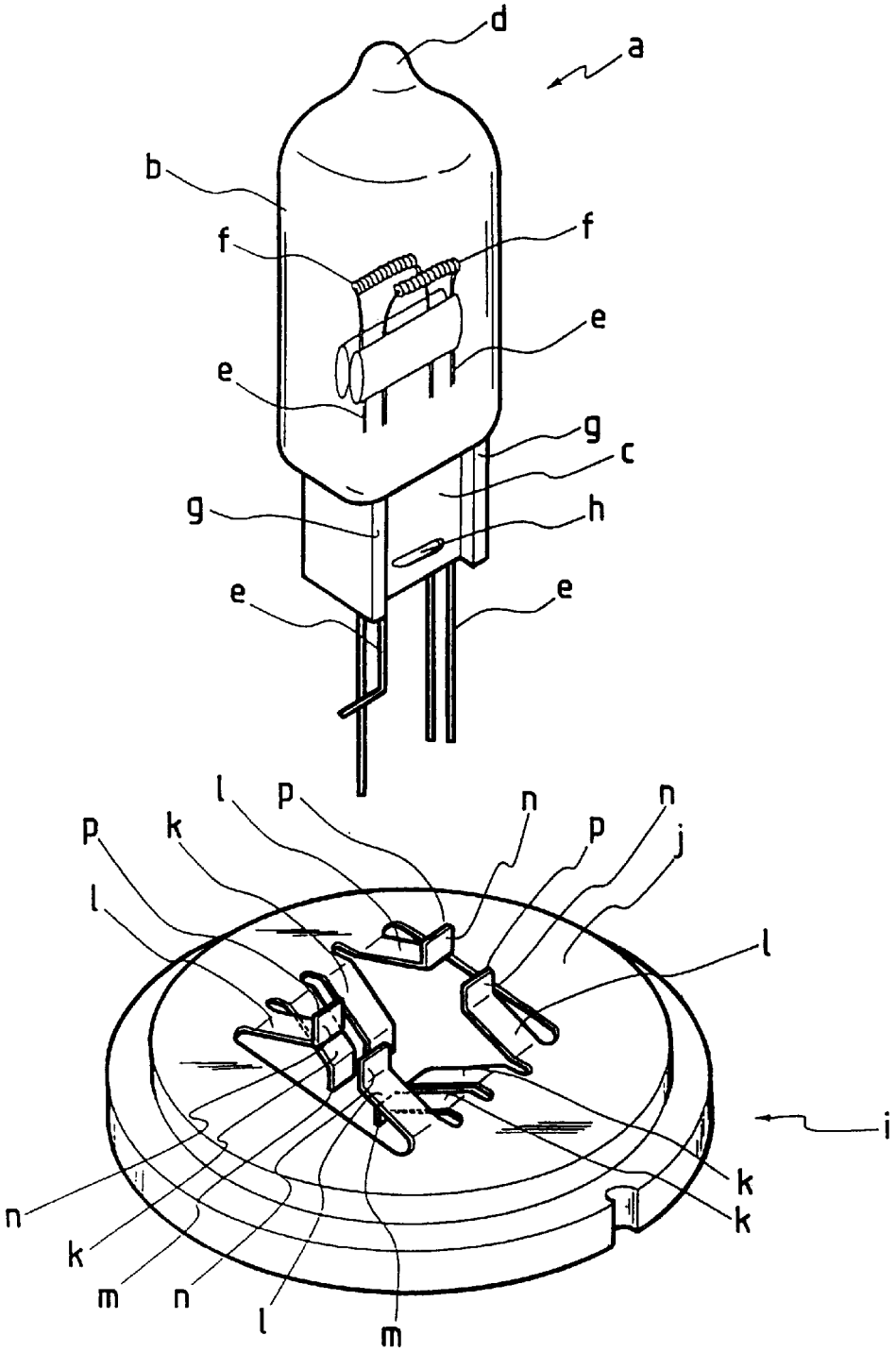
FIG. 6 PRIOR ART
FIG. 6 is a perspective view of a conventional electric lamp with a base, showing a state thereof in which a bulb capsule is detached from a hold plate.
Figure 7:
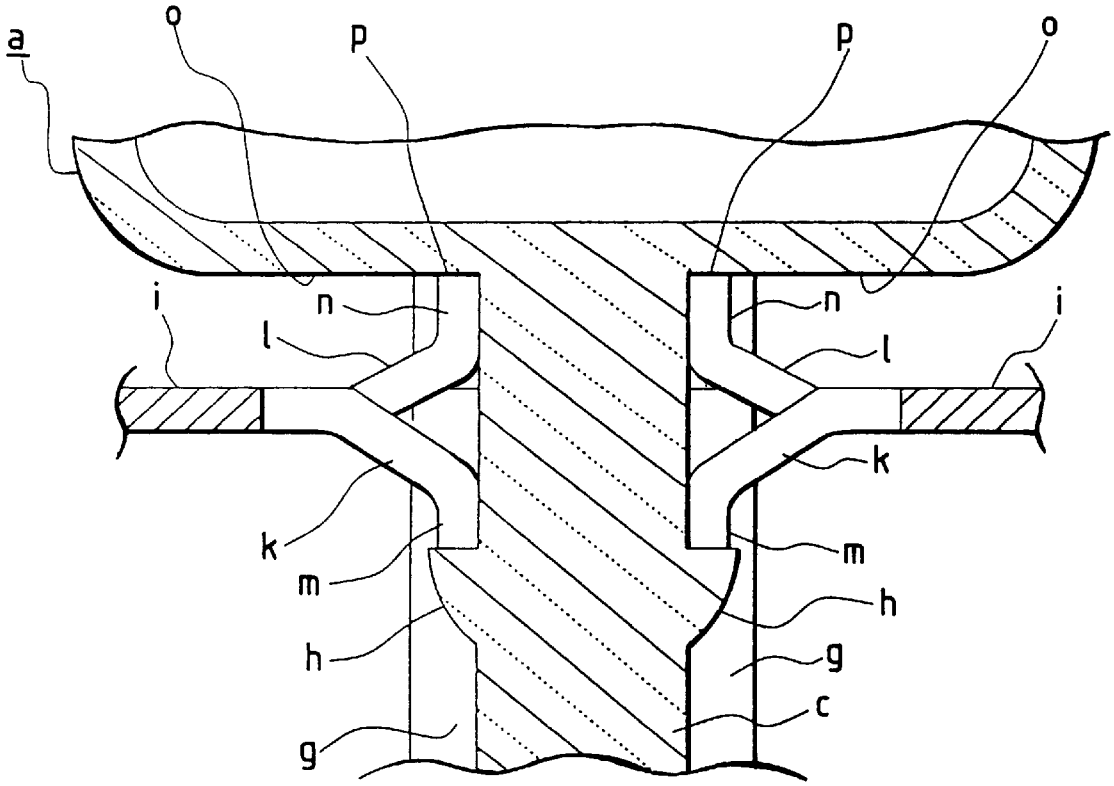
FIG. 7 PRIOR ART
FIG. 7 is an enlarged section view of the main portions of the conventional electric lamp with a base, showing a state thereof in which a bulb capsule is connected with a hold plate.

Now, in the present bulb capsule 1, the pinch seal portion 3 thereof is inserted from above between the hold pieces 16, 17 of the hold plate 12 until, as can be seen well from FIG. 5, the bent portions 20 of the glass bulb hold pieces 17 respectively contact with the thick portion 7 of the pinch seal portion side end portion 6 of the glass bulb 2 and the leading end portions 18 of the pinch seal side hold pieces 16 are engaged with the engaging projection sections 11.

In this insertion operation, the glass bulb side hold pieces 17 are allowed to slip through between the leading ends of the engaging projections 11 and projections 10 of the pinch seal portion 3 and reach the pinch seal portion side end portion 6 of the glass bulb 2, while the leading end portions 18 of the pinch seal side hold pieces 16 engage the engaging projection sections 11 once and, after that, are respectively engaged with the upper sides of the engaging projection sections 11.

And, in this state (which is shown in FIG. 5), the leading end portions 18 of the pinch seal side hold pieces 16, which are insituated below the hold surface 15, are elastic contact with the side surface of the intermediate portion of the pinch seal portion 3 of the bulb capsule 1 from both sides to thereby hold the pinch seal portion 3. Also, not only are the leading end portions 18 of the pinch seal side hold pieces 16 engaged with the upper surfaces of the engaging projection sections 11, but also the outer sections of the bent portions 20 of the glass bulb side hold pieces 17 in contact with the thick portions 7 of the pinch seal portion side end portion 6 of the glass bulb 2, thereby preventing the bulb capsule 1 from being removed from the hold plate 12.

Thus, since the portions of the glass bulb 2 with which the glass bulb side hold pieces 17 are contacted are the thick portions 7 formed in the pinch seal portion side end portion 6 of the glass bulb 2, even if stresses caused by the engagement of the glass bulb side hold pieces 17 are concentrated on the present thick portions 7, the present thick portion 7 is able to stand such stresses. Also, because the portions of the glass bulb 2 which engage with the bent portions 20 of the glass bulb side hold pieces 17 are the thick portions, it is possible to prevent the glass bulb 2 against such damage which can occur when the sharp edge portions of the glass bulb hold pieces 17 are engaged with the glass bulb 2.

Since the leading ends 19 of the glass bulb side hold pieces 17 are formed such that the distances between the mutually opposed ones are slightly larger than the thickness of the pinch seal portion 3, the present leading ends 19 are prevented against contact with the pinch seal portion 3.

As can be clearly understood from the foregoing description, according to the invention, since the pinch seal portion side end portion of the glass bulb is structured such that a section thereof, with which the glass bulb side hold pieces of the hold plate can be engaged, is formed larger in thickness than the remaining sections thereof, even if stresses due to the engagement of the glass bulb side hold pieces are concentrated on the present section, the present section is able to stand such concentrated stresses.

Further, the contact surface of the contact section of the pinch seal portion side end portion of the glass bulb, with which the glass bulb side hold pieces are to engage, is formed such that it makes an angle of almost 90 degrees with respect to the pinch seal portion.

Due to this, a pressing force due to the engagement of the glass bulb side hold pieces can be received almost at right angles with respect to the direction of action of thee pressing force.

Further, each of the glass bulb side hold pieces is so formed as to have a bent portion, the outer section of the bent portion engages with the pinch seal portion side end portion of the glass bulb, and the leading end of the bent portion is so extended toward the pinch seal portion side as to provide a clearance between the pinch seal portion and itself. Due to this, there is eliminated the possibility that there can be generated any burr in the outer sections of the bent portions of the glass bulb side hold pieces, thereby preventing the pinch seal portion side end portion of the glass bulb against damage. Also, the section of the leading end portion of the glass bulb, in which burrs are produced, is spaced apart from the pinch seal portion, there is also eliminated the danger that the pinch seal portion can be damaged.

In the above-mentioned embodiment, there are illustrated some concrete shapes and structures but they are only the examples of embodiments according to the invention. That is, it should be noted here that the technological scope of the invention is not limited to them.

What is claimed is:

1. An electric lamp comprising:

a bulb capsule comprising:

a glass bulb formed integrally with said bulb capsule; filaments sealed in said glass bulb;

a substantially flat pinch seal portion formed integrally with said glass bulb in one end portion thereof; said pinch seal portion comprising engaging projection sections formed at an intermediate portion thereof; and a thickened section formed at a pinch seal portion side end portion of said glass bulb, said thickened section being located at a boundary of said glass bulb and said pinch seal portion, said thickened section being larger in thickness than other parts of said glass bulb; and a hold plate connecting with said pinch seal portion of said bulb capsule, said hold plate comprising:

pinch seal side hold pieces for holding said pinch seal portion from both sides thereof and engageable with said engaging projection sections of said pinch seal portion; and glass bulb side hold pieces engageable with said pinch seal portion side end portion of said glass bulb, said glass bulb side hold pieces contacting said thickened section of said bulb capsule and including leading end portions which extend toward said pinch seal portion, wherein distances between the leading end portions of the mutually opposed glass bulb side hold pieces are slightly larger than the thicknesses of the portions of said pinch seal portion which face said leading end portions, so that the leading end portions do not contact the pinch seal portion.

2. An electric lamp as set forth in claim 1, wherein a contact surface of said section of said pinch seal portion side end portion, with which said glass bulb side hold pieces are to be engaged, is formed at substantially right angles with respect to said pinch seal portion.

3. An electric lamp as set forth in claim 1, wherein said glass bulb side hold pieces respectively comprises bent portions, outside sections of said bent portions engage with said pinch seal portion side end portion of said glass bulb, and leading end portions of said glass bulb side hold pieces extend toward said pinch seal portion.

4. An electric lamp as set forth in claim 3, wherein said glass bulb side hold pieces are formed opposed to each other, and are respectively bent in an obliquely upward direction, and the leading end portions of said glass bulb side hold pieces are bent in an obliquely downward direction.

5. A bulb capsule for an electric lamp having a lamp base, the bulb capsule comprising:

a glass bulb formed integrally with said bulb capsule;

filaments sealed in said glass bulb;

a substantially flat pinch seal portion formed integrally with said glass bulb in one end portion thereof; said pinch seal portion comprising engaging projection sections formed at an intermediate portion thereof; and a thickened section formed at a pinch seal portion side end portion of said glass bulb, said thickened section being located at a boundary of said glass bulb and said pinch seal portion, said thickened section being larger in thickness than other parts of said glass bulb and said thickened section meets said pinch seal portion at a substantially right angle.

6. A hold plate for an electric lamp including a glass bulb having a pinch seal portion, the hold plate comprising:

pinch seal side hold pieces which hold said pinch seal portion from both sides thereof; and glass bulb side hold pieces engageable with said glass bulb, said glass bulb side hold pieces respectively comprise bent portions, wherein outside sections of said bent portions engage with a pinch seal side end portion of said glass bulb, leading end portions of said glass bulb side hold pieces extend toward said pinch seal portion, and distances between the leading end portions of the mutually opposed glass bulb side hold pieces are slightly larger than the thicknesses of the portions of said pinch seal portion which face said leading end portions so that the leading end portions do not contact the pinch seal portion.

7. A hold plate as set forth in claim 6, wherein said glass bulb side hold pieces are formed opposed to each other, and are respectively bent in an obliquely upward direction, and the leading end portions of said glass bulb side hold pieces are bent in an obliquely downward direction.

* * * * *